United States Patent [19]

Kuhn et al.

[11] Patent Number: 4,802,844

[45] Date of Patent: Feb. 7, 1989

[54] HIGH CAPACITY, RETRACTABLE FURNACE HEARTH

[75] Inventors: Timothy J. Kuhn; James W. Bender, both of Toledo; Arvind C. Thekdi, Sylvania, all of Ohio

[73] Assignee: Gas Research Institute, Chicago, Ill.

[21] Appl. No.: 146,195

[22] Filed: Jan. 20, 1988

[51] Int. Cl.[4] ..... F27B 9/14; F27B 5/12

[52] U.S. Cl. ..... 432/126; 432/241; 432/246; 432/236; 266/253; 266/277

[58] Field of Search ..... 432/246, 234, 235, 236, 432/126, 136; 266/253, 277

[56] References Cited

U.S. PATENT DOCUMENTS

| | | | |
|---|---|---|---|
| 1,946,270 | 2/1934 | Breaker | 263/28 |
| 2,830,805 | 4/1958 | Harris | 266/4 |
| 2,869,856 | 1/1959 | Greene | 266/5 |
| 4,003,714 | 1/1977 | Foglino et al. | 23/290 |
| 4,214,868 | 7/1980 | Tabuchi | 432/246 |
| 4,403,953 | 9/1983 | Suzuki | 432/126 |
| 4,421,481 | 12/1983 | Holz et al. | 432/239 |
| 4,455,177 | 6/1984 | Filippov et al. | 266/253 |
| 4,512,558 | 4/1985 | Lueth | 266/249 |

*Primary Examiner*—Henry C. Yuen

*Attorney, Agent, or Firm*—Body, Vickers & Daniels

[57] ABSTRACT

A retractable, roller hearth for use in an industrial heat treat furnace is disclosed whereby the alloy rollers are retracted from their load bearing position when the furnace heat treat processes are underway thus maintaining the rated load capacity of the furnace. A plurality of guided rail support posts and guided, sealed lift posts accurately assure straight line vertical motion of the refractory base enabling contact between fibrous rope seals to seal the hearth from the cooler, lower portions of the furnace when the hearth is in a raised position.

29 Claims, 4 Drawing Sheets

HIGH CAPACITY, RETRACTABLE FURNACE HEARTH

This invention relates generally to industrial heat treat furnaces and more particularly to a retractable, refractory roller furnace hearth for use in the furnace.

The invention is particularly applicable to batch type, positive pressure industrial heat treat furnaces subjected to heavy workpiece loads at elevated temperatures and will be described with particular reference thereto. However, the invention may have broader application and could, conceivably, be applied to other heat treat furnaces.

BACKGROUND

In typical batch type industrial heat treat furnaces operated at positive pressures, workpieces are loaded into a wire mesh work tray which is moved into the furnace chamber for the heat treat process and thence out of the furnace chamber into a quench chamber or a vestibule. When the tray is loaded, it is quite heavy, often in excess of 1,000 lbs and movement of the loaded tray into and out of the furnace chamber can become difficult. It is thus conventional to imbed rollers into the refractory floor or hearth in the furnace chamber and use a drive chain arrangement to automatically pull or push the loaded work tray into and out of the furnace chamber. Such arrangements are conventionally referred to as roller rail hearths.

Batch type heat treating furnaces operated at positive pressures are general, all purpose type furnaces which are designed so that a wide configuration of different parts can be heat treated in accordance with any number of different heat treat processes. Such furnaces fundamentally require an integral box type furnace chamber which is soundly insulated in contrast to other types of furnaces which may have certain structural provisions for treating particular part configurations or applicability for only certain type of heat treat processes.

No matter what heat treat process is employed but particularly for high temperature processes such as carburizing, it is important from an economic (as well as possibly from a process) point of view to heat the work to its heat treat temperature as quickly as possible. In this direction, efforts have been made to produce higher and higher furnace heating rates with, for example, gas burners so as to reduce the time it takes to raise the temperature of the work to its heat treat temperature. At present, it is not uncommon, for example in a batch type carburizing process, to supply heat to the furnace chamber from the radiant tubes which are at temperatures of between 1950° and 2050° F. When the conventional roller hearth is subjected to such temperatures, the thermal stress induced in the roller support arrangement coupled with the heavy work loads easily cause permanent distortion of the roller support. To avoid such distortion, the furnace manufacturers have been forced to reduce the capacity of the furnace as a way to insure that the overall stress level on the roller supports does not exceed the elastic limit of the material.

Movable hearths are known in the furnace art. Conventional rotary hearths use doughnut shaped refractory beds which rotate within a fixed housing as the work deposited thereon is sequentially heated in a predetermined manner as it passes through several fixed stations within the hearth. Another movable hearth arrangement is car bottom furnaces which are conventionally used in steel mill applications, for annealing and tempering. In such arrangements, a cart rolling on a rail is actually rolled under a bottomless furnace enclosure which is then sealed to the cart to form the furnace enclosure. Such arrangements typically use sand seals to establish the furnace enclosure between the car bottom and the furnace walls which, while perfectly acceptable in steel mill applications are not adequate for the repeated loadings encountered in batch type industrial heat treat furnace arrangements.

Nevertheless, within the literature, variations on the car bottom approach, using sand seals, can be found in the art such as in U.S. Pat. No. 1,946,270 to Breaker and U.S. Pat. No. 2,869,856 to Greene both of which use a hydraulic ram to lift a hearth into the open bottom of a furnace chamber in an industrial furnace application. In addition, once the hearth is lowered, all the furnace temperatures are released rendering such devices uneconomical. A further variation on the car bottom furnace may be found in U.S. Pat. No. 4,421,481 to Holz et al in which cars are rolled into an enclosure end to end for the stated purpose of forming a hearth. Holz is relevant to the present invention only in the sense that some form of a movable hearth is thus disclosed.

SUMMARY OF THE INVENTION

It is thus a principal object of the present invention to provide a high capacity roller hearth for use in an industrial heating furnace which retains its load bearing capacity despite the fact that the heat treat furnace is operated at elevated temperatures.

This object along with other features of the present invention is achieved in a conventionally constructed batch type heat treat furnace which has an insulated furnace chamber, a door into the furnace chamber for entry and exit of the work, conventional heating means within the furnace chamber providing heat to the atmosphere within the chamber, conventional fan circulating means within the chamber circulating furnace atmosphere within the chamber and means to supply a furnace atmosphere and a heat treat atmosphere to the furnace chamber. A conventional work tray which preferably is a wire mesh construction so that furnace atmosphere can flow not only through the sides but the bottom of the tray is loaded with ferrous or metal workpieces and drawn by a conventional mechanism into and out of the furnace chamber where the loaded work tray rests on a retractable, refractory hearth. The hearth comprises a refractory base having a bottom surface, a top surface and a closed peripheral edge surface extending between the bottom and the top surfaces. A tile support mechanism which extends from the top surface of the refractory base, when acutated, supports the work tray when the furnace chamber is heat treating the work. A roller rail mechanism also extending from the top surface of the refractory base and including a plurality of rollers, when actuated, supports the work tray to permit movement of the tray into and out of the furnace chamber in a rolling, anti-friction bearing manner similar to that of conventional roller hearths. A hearth lift mechanism effects relative movement between the roller rail mechanism and the tile mechanism while the refractory base is maintained entirely within the furnace chamber so that the roller rail mechanism or the tile mechanism is alternately actuated to remove any loading of the roller rail mechanism when the furnace chamber is initially heated at the excessive temperatures. In fact, only at the end and the beginning of the heat treat cycles is the roller rail mechanism subjected to any mechanical loading at elevated temperature thus allowing the capacity of the heat treat furnace to be maintained at the same load level irrespective of the operating temperatures of the furnace. Thus, the temperature of the furnace chamber can always be maintained at elevated temperatures, notwithstanding the transfer of work into and out of the furnace chamber while the roller hearth is subjected to only brief loading at the elevated but not necessarily the peak temperature so as to maintain a constant high capacity furnace load rating.

In accordance with another feature of the invention, a sealing mechanism between the refractory base and the furnace chamber is provided. The sealing mechanism is actuated only when the hearth lift mechanism actuates the tile support mechanism at which time the furnace chamber is effectively sealed into a first and second enclosure with the first enclosure including the work tray and the top surface of the refractory base while the second enclosure includes the bottom surface of the refractory base. Since the second enclosure is not as thoroughly insulated as the first enclosure, furnace atmosphere which otherwise would escape to the lower temperature enclosure and deposit carbon when a carburizing process heat treat process was being effected within the furnace is thus prevented thereby improving the efficiency of the heat treat process and minimizing the use of the carbon bearing gas, i.e. methane.

In accordance with another feature related to this seal a fibrous rope member is disposed within a groove formed about the peripheral edge surface of the refractory base such that the rope member extends outwardly beyond the edge surface. A similar second rope member is similarly disposed within a groove formed within the furnace chamber but axially spaced from the first rope member such that when the hearth lift mechanism actuates the tile support mechanism the first rope member contacts the second fibrous rope member to provide a seal while also permitting thermal expansion of the refractory base member within the furnace chamber without incurring any binding therebetween. A simple seal which can be subjected to repeated loadings without failure thus results.

In accordance with yet another aspect of the invention, the roller rail mechanism includes a first and second roller rail guide, each guide supporting a plurality of rollers in a line extending from one end to the opposite end of the refractory base. A plurality of stationary post assemblies equally positioned along each roller guide are provided with one end of each post assembly secured to the guide and the opposite end of each post assembly secured to a fixed structural point within the furnace chamber such that each post assembly extends through the refractory base from the top surface to the bottom surface. A seal arrangement is provided between the stationary posts and the refractory base to prevent furnace atmosphere from escaping through the refractory base while there are also provided guides with each post assembly to maintain the centered attitude of the refractory base within the furnace enclosure while securely supporting the roller rail member against deformation at several points along the length thereof.

In accordance with another aspect of the invention, the refractory base member is lifted within the furnace chamber by at least one post member secured at one end to a structural member in turn secured to the bottom side of refractory base member and at its other end to a lift mechanism located outside of the furnace chamber with each post sealed in a stuffing box arrangement so that leakage of air into the enclosure does not occur as the post moves relative to the furnace chamber. The seal arrangement also functions as a guide for each post and preferably four spaced posts are utilized to insure a straight line axial lift motion of the refractory base member within the furnace enclosure. The guides on the lift posts in combination with the guide on the rail support posts insure the centered relationship of the hearth thus permitting the fibrous seal members to effectively seal the chamber into the first and second furnace enclosures as defined above.

In accordance with yet another feature of the invention the tile support mechanism includes at least a first and second plurality of ceramic tiles extending from the top surface of the refractory base a fixed distance therefrom such that when the tile support mechanism is actuated by the hearth lift mechanism, the tiles extend beyond the rollers for supporting the work tray. The first and second pluralities of tiles are arranged generally parallel to the roller rail guide with spaces provided therebetween for circulation of the atmosphere through the underside of the work tray to assure more efficient cooling of the workpieces therein. Additionally, a plurality of "H" shaped ceramic tile pieces are placed end to end to extend from one end to the other end of the refractory base member with one base of each "H" shaped tile embedded within the top surface of the refractory base to define an upstanding U-shaped member. The legs of the U-shaped member extend from the top surface of the refractory base a distance equal to that which the first and second pluralities of tiles extend. Contained within the bight portion of the "U" is the chain drive mechanism which conveys the work tray into and out of the furnace chamber. The U-shaped tiles in combination with the first and second plurality of tiles defines a totally ceramic, refractory, multi-point stable support for the work tray when the work is heated which permits circulation of the furnace atmosphere to the bottom of the work tray as well as the sides and the top thus efficiently heating and heat treating the workpieces within the work tray.

It is thus another object of the present invention to provide a retractable roller hearth which enhances the heat treat processes carried on by the heat treat furnace within which the hearth is disposed.

It is yet another object of the invention to provide an extremely stable retractable hearth for use in an industrial heat treat furnace which permits a simple seal to be used despite the distortion of the hearth and the axial movement thereof.

It is yet another object of the invention to provide a retractable furnace hearth which permits the flow of furnace atmosphere gases about the workpieces contained within the furnace chamber.

It is another object of the invention to provide a retractable roller hearth which has an insignificant down time for maintenance.

It is another object of the invention to provide a hearth which conserves the heat treat gases otherwise required to heat treat on a workpiece.

Yet another object of the invention is to provide a retractable roller hearth which can be used in furnaces which employ a high, initial preheat temperature.

Still another object of the invention is to provide a simple, inexpensive retractable furnace hearth.

DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF THE PREFERRED EMBODIMENT

Figure 1:
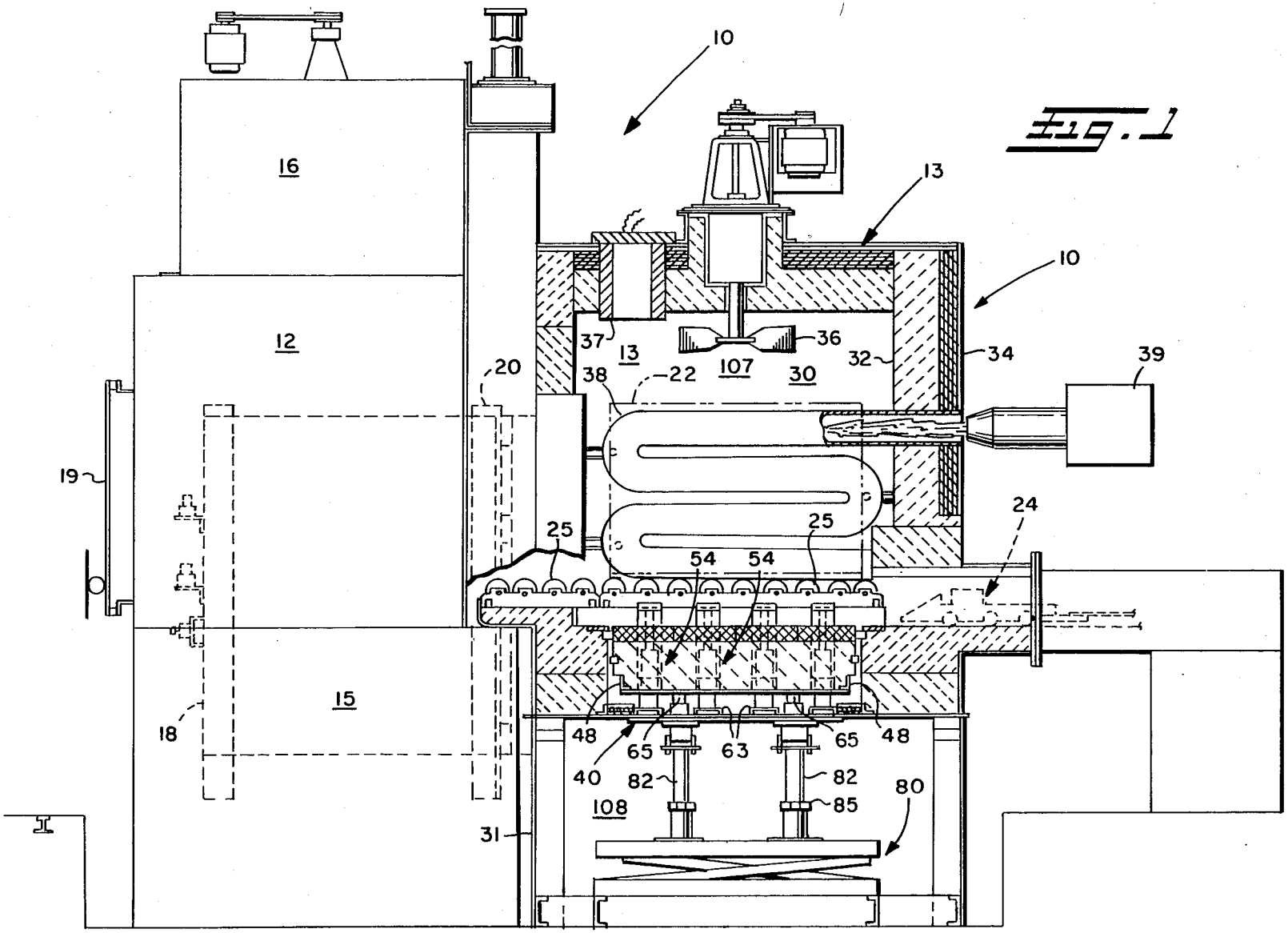
FIG. 1 is a general side view of an industrial heat treat furnace with the furnace casing broken away in the furnace chamber to show the retractable roller hearth of the present invention.

Referring now to the drawings wherein the showings are for the purpose of illustrating a preferred embodiment of the invention only and not for the purpose of limiting the same, FIG. 1 shows a conventional, multi-chambered, batch type industrial heat treat furnace 10. Furnace 10 includes the vestibule or charging chamber section 12, a furnace section 13 located behind vestibule 12, a quench tank 15 located beneath vestibule section 12 and a top cool section 16 located above vestibule section 12. A conventional elevator schematically illustrated at 18 is provided for moving the work vertically from the vestibule section 12 into quench tank 15, or if the heat treat processor calls for gas cooling, top cool section 16 is activated for cooling the work in a conventional manner. A sealed vestibule door 19 is provided for placing work into vestibule section or removing work therefrom and a conventional hydraulic cylinder actuated sealed furnace door 20 is provided for moving work from vestibule section 12 to furnace section 13 and visa versa. The work which typically comprises various piece parts are stacked in a work tray shown by phantom line 22 in FIG. 1. Work tray 22 is essentially a box of a wire mesh type construction so that the furnace atmosphere can be circulated completely about the entire surface of the workpieces within work tray 22. Work tray 22 is rigidized at its bottom (not shown) for engagement with a tray handler head (drawn in phantom) 24 of a chain drive mechanism which is also conventional in the art and not further described in detail herein. Work tray 22 rests on rollers 25 supported on a track which extends into vestibule and furnace sections 12, 13 so that work tray 22 can be rolled in an anti-friction bearing manner from vestibule section 12 to furnace section 13 and from furnace section 13 to vestibule section 12. Movement of work tray 22 from and to the various furnace sections is accomplished automatically after work tray 22 is placed in vestibule section 12 in accordance with the requirements of whatever the heat treat process calls for by means of chain drive mechanism and the automatic engagement and disengagement of tray handler head 24. Other conventional push-pull arrangements can be used in place of the chain drive mechanism illustrated.

Furnace section 13 essentially comprises a sealed, refractory enclosed furnace chamber 30. Generally speaking and is well known in the furnace art, structural members tied to a structural framework as shown at 31 support refractory sections such as indicated at 32 which are covered by a furnace skin 34 to define furnace chamber 30. Refractory sections 32, depending on the furnace construction and use can be cast refractories, ceramic, fire brick or a fibrous or felt type insulation secured to furnace skin 34 by being impaled on pin and washer arrangements. Extending into the furnace is a conventional axial bladed furnace fan 36 for circulation the furnace atmosphere within furnace chamber 30 throughout work tray 22 in a conventional manner. Also extending into furnace chamber 30 is a gas generator 37 which generates gases, either atmosphere, carrier or heat treat processing atmospheres all in a conventional manner and not further described in detail herein. Gas generator 37, however, is not essential to the workings of the present invention and could be replaced by a gas tube or tubes controlled by a microprocessor which function to emit furnace processing gases within furnace chamber 30 in a conventional manner. Also disposed within furnace chamber 30 is a conventional radiant tube 38 for supplying heat to furnace chamber 30 in a conventional manner. As is well known in the furnace art, the heat treat or furnace atmosphere must be carefully controlled and if electrical resistance heating elements are the source of heat for a positive pressure furnace of the type disclosed, the electric resistance heating elements are disposed within radiant tubes 38 to prevent corrosive attack or other degradation of the elements by the atmosphere. Preferably, however, gas fired burners 39 are desired as the source of heat for the positive pressure furnaces of the type illustrated herein both from an economic and output consideration basis. Radiant tubes 38 are necessary to separate or contain the products of combustion emanating from gas fired burners 39 from co-mingling with the furnace atmosphere in furnace chamber 30 (although various schemes have been employed in the past to permit highly efficient gas fired burners 39 to fire the products of combustion directly into furnace chamber 30 with appropriate sensors and microprocessors used to add the necessary heat treat gas elements to furnace chamber 30). The products of combustion from gas fired burners 39 exit radiant tubes 38 through an exhaust outlet (not shown) to a stack which may or may not include a heat exchanger to recover sensible heat generated in the process which may be used to preheat the combustion air for gas fired burners 39 or for other conventional purposes known in the art (not shown). Developments in gas fired burners in recent years have increased the heat output of such burners and this invention is specifically contemplated to be used with such high output burners. Today, such burners are capable of heating radiant tubes 38 to temperatures of 2100°–2200° F. and perhaps higher with ceramic tubes. From a heat treat processing time consideration, it is desirable to heat cold work to its heat treat temperature as quickly as possible. Thus it is desired that the radiant tubes be at a substantially higher temperature initially than that required by the heat treat cycle so that the work can be raised to the heat treat temperature as quickly as possible. When the work reaches its heat process temperature, appropriate burner controls (not shown) are then provided to cut back the firing rate of burners 39 to reduce the radiant tube temperature to the heat treat temperature whereat the heat treat cycle will take place. This is usually accomplished by simply locating thermocouples within the furnace or workpieces or by the use of optical temperature recording devices. This initial high heat scheme described is conventional and has been used with success in the reheating of slabs and billets by direct firing of gas burners in the steel mill furnace area. Heretofore, such initial high heat scheme has not been practiced in batch type industrial heat treat furnaces, or at least to the extent practiced herein at the temperatures noted, because of structural limitations of the furnace.

Figure 2:
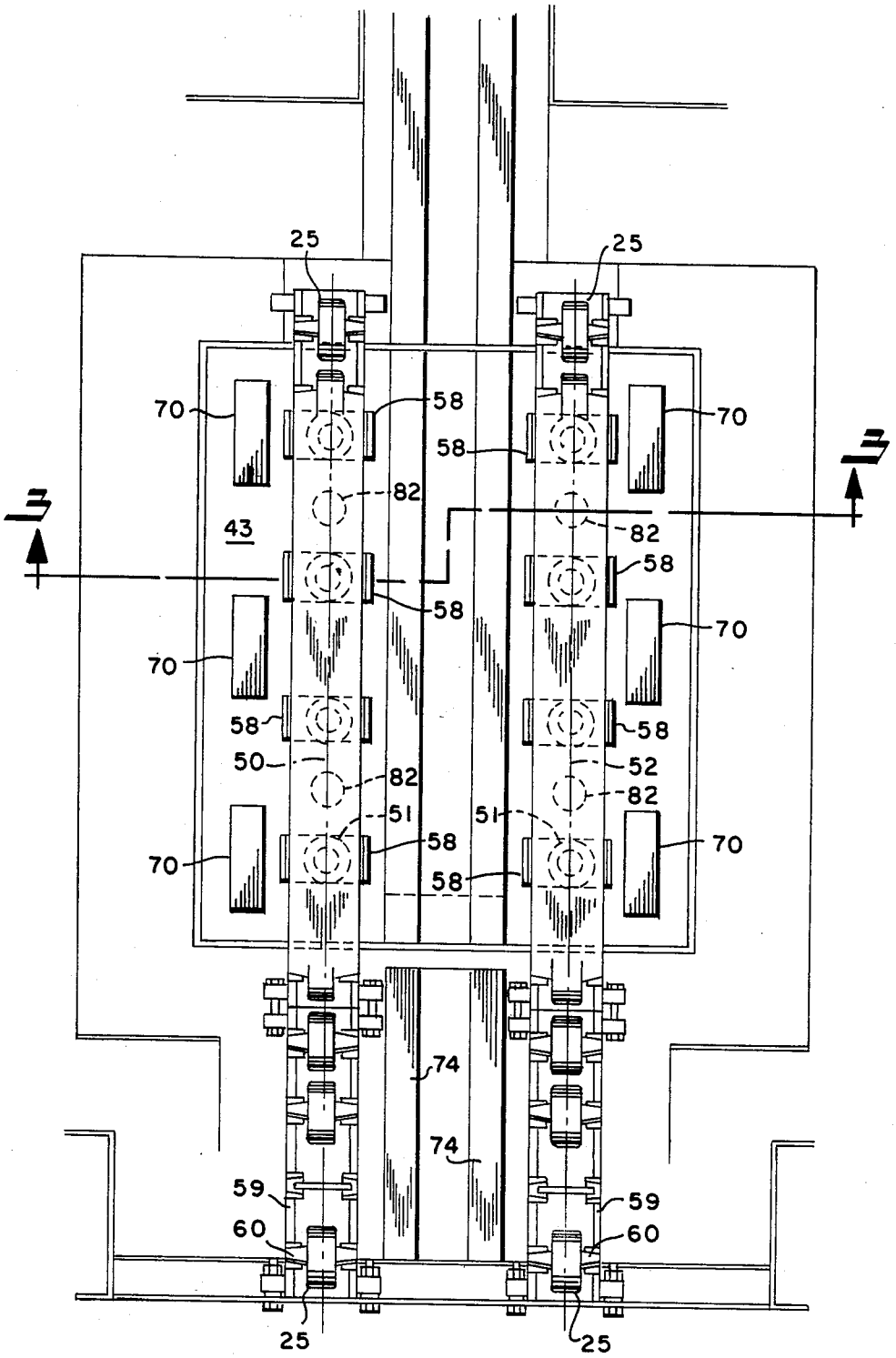
FIG. 2 is a top plan view of the retractable roller hearth.
Figure 3:
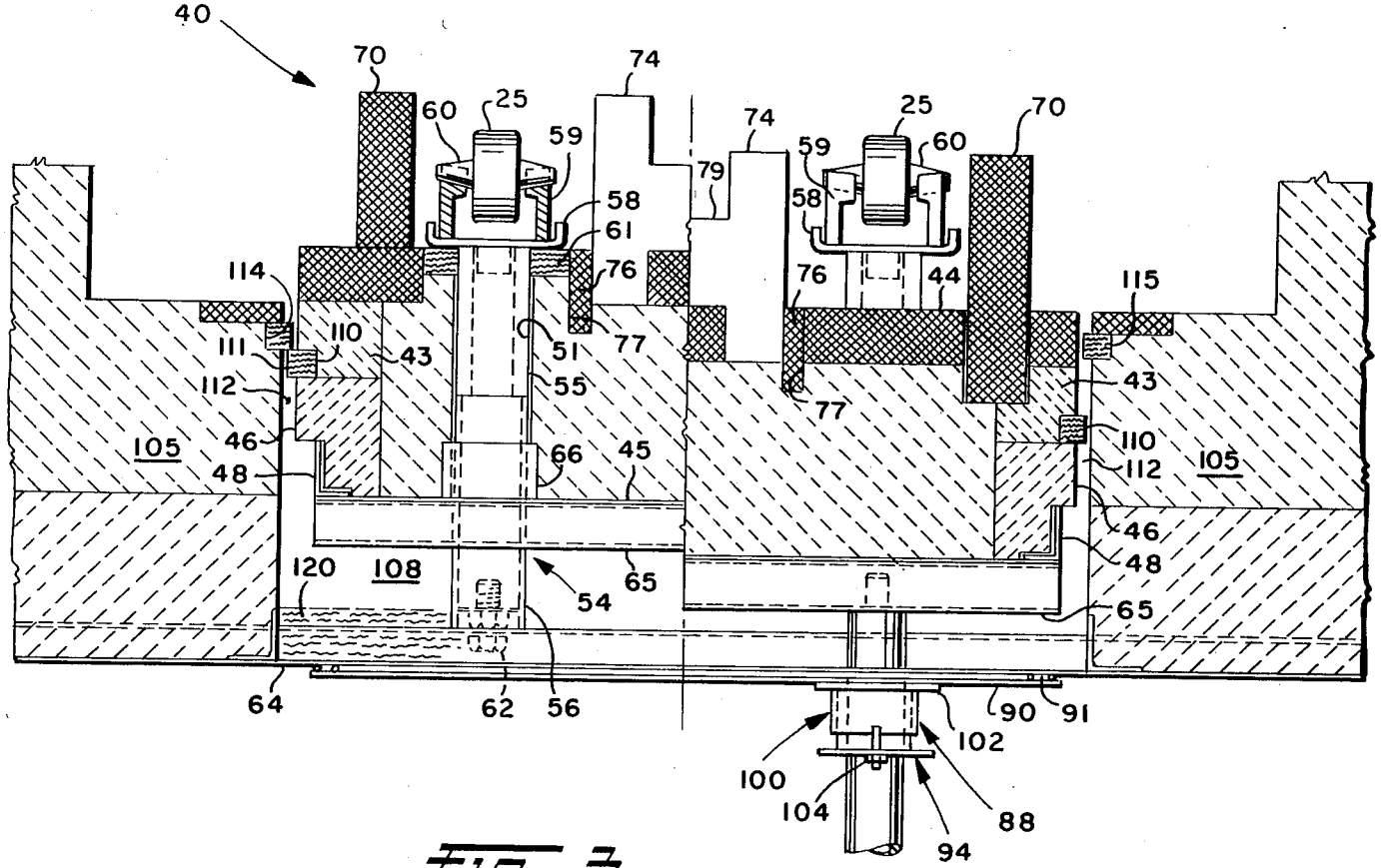
FIG. 3 is a section split view of the hearth taken along lines 3—3 of FIG. 2 showing the hearth in a raised and lowered position.

At the bottom of furnace chamber 30 is a retractable roller hearth 40. Referring now to FIGS. 1, 2 and 3, retractable roller hearth 40 includes an essentially solid one piece refractory base 43 which as best shown in FIG. 2 is rectangular in configuration and conform to the outline of furnace chamber 30. Refractory base 43 has a top surface 44, a bottom surface 45 and a peripherally extending edge surface 46. Structural angle members 48 positioned at the intersection bottom and edge surfaces 45, 46 box in and rigidize refractory base 43. Extending along a first longitudinal axis 50 (FIG. 2) are four equally spaced rail support post openings 51 extending from top surface 44 through bottom surface 45 of refractory base 43. Similarly extending along second longitudinal axis 52 are four similarly positioned rail support post openings 51. A rail support post arrangement 54 extends through each rail support post opening 51. As best shown in FIGS. 1 and 3, each rail spport post arrangement 44 includes an upper tubular member 55 with one end extending above top surface 44 and abutting against, at its opposite end, with a lower tubular member 56, which extends through bottom surface 45 of refractory base 43. The outside diameters of tubular members 55, 56 are equal with upper tubular member 55 having a significantly thicker wall section than lower tubular member 56. Attached to the exposed end of upper tubular member 55 is a laterally extending U-shaped roller rail guide 58. The upstanding legs of roller rail guide 58 cradle roller rail supports 59 which are parallel to first and second longitudinal axis 50, 52 as shown in FIGS. 2 and 3 and are arcuately configured at space locations to rotably support the trunnions 60 of rollers 25 positioned at equal increments along the length of roller rail supports 59. Placed underneath and generally about roller rail guide 58 and on top of top surface 44 of refractory base 43 is a one inch, eight pound ceramic blanket 61 which seals upper tubular member 55 within rail support post opening 51 preventing the flow of furnace atmosphere through rail support post opening 51. The bottom end of lower tubular member 56 is securely bolted as at 62 to an inverted, laterally extending channel member 63 (FIG. 1) which extends beyond refractory base 43 and is tied to structural framework 31 (not shown) of furnace section 13. The legs of inverted channel members 63 rests on the bottom furnace casing portion 64 of furnace skin 34 and in turn is supported by structural framework 31. Each channel member 36 supports two rail support post arrangements 54, there being four channel member 63 shown. At bottom surface 45 of refractory base 43, each rail support post opening 51 is enlarged to receive a metal ring shaped post guide member 66 which is pressed into rail support post opening 51 from bottom surface 45 of refractory base 43. When refractory base 43 is raised or lowered within furnace chamber 30, post guide member 66 insures that refractory base 43 moves only in a vertical direction and does not tilt or cock or assume any horizontal motion and this selfaligning feature will be important for reasons which will hereafter be explained. Furthermore, any tendency of rail support post arrangement 54 to cock within rail support post opening 51 will not result in a wear or an abrasion of refraction base 43. Satisfactory alignment results have been obtained using a 4 inch OD rail support post arrangement 54 within a $4\frac{1}{4}$ inch I.D. post guide member 66.

Referring still again to FIGS. 2 and 3, laterally disposed on the outside of roller rail supports 59 is a support ceramic tile 70, there being six such tiles illustrated, with each support tile 70 having a length of about $13\frac{1}{2}$ inches, a height of about 9 inches and a width of about 3 inches. As shown in FIG. 3, support tiles 7 extend above rollers 60 when refractory roller hearth 40 is raised and dropped below rollers 60 when refractory roller hearth 40 is lowered. Support tiles 70 are fitted loosely into recesses 71 formed in top surface 44 of refractory base 43 and the looseness of the fit between support tiles 7 and recesses 71 is taken up by Kaowool paper 72 packed therebetween thus permitting some attitudinal alignment of support tiles 70 when supporting the weight of work tray 22 without it causing an abrasion between support tiles 70 and refractory base 43. As best shown in FIG. 2, support ceramic tiles 70 are spaced from one another to permit the flow of furnace atmosphere therebetween from top surface 44 of refractory base 43 through the bottom of work tray 22.

Referring now to FIG. 3, positioned at the middle and extending from top surface 44 of refractory base 43 are a plurality of H-shaped guide support tiles 74 which are placed end to end to longitudinally extend in a continuous manner from one end to the other end of refractory base 43. (As used herein end to end means the longitudinal direction of roller support hearth 40 while side to side means the lateral direction of the hearth.) Each H-shaped tile is maintained in its position on top surface 44 of refractory base 43 by outside tiles 76 engaging the outside surfaces of the legs of the H-tiles 75 and are wedged into longitudinally extending recesses 77 formed within top surface 44. H-shaped tiles 75 have an upper bight portion 79 which forms a longitudinally extending channel from one end to the other end of refractory base 43 which guides tray handler head 24 and the chain when work tray 22 is moved into and out of furnace chamber 30. Thus when refractory base 43 is in its raised position, work tray 22 is supported along four longitudinally extending support lines defined by the two outer rows of support ceramic tiles 70 and the two upstanding legs of H tiles 75. As noted, tiles 70, 75 assume some relative movement with respect to top surface 44 to adjust to the loading of work tray 22 while still maintaining an even load transmitted to refractory base 43 of retractable roller hearth 40. Movement between raised and lowered positions of retractable roller hearth 40 is approximately 3 inches.

The lifting mechanism for retractable roller hearth 40 includes a scissors mechanism 80 which support four lift posts 82. While any mechanism could in theory be used to raise or lower lift posts 82, the scissors mechanism 80 is particularly advantageous in that because of the mechanical advantage obtained a smaller actuator need be employed to lift the posts than that which is otherwise required and, importantly, all lift posts 82 are uniformly raised or lowered the same discrete distance. However, other lift mechanisms can be employed. Each lift post 82 extends through bottom furnace casing section 64 and is secured at its end to a laterally extending structural box shaped member 65 in turn secured to opposite angle members 48 on bottom surface 45 of refractory base 43, there being two laterally extending box members 65 with each box member 65 supporting two lift posts 82. Angle members 48 in combination with box members 65 provide a rigid framework for refractory base 43 while the four lift posts 82 assure smooth raising and lowering of refractory base 43. An adjusting nut 85 between each lift post 82 and a tubular receiving housing 86 on scissors mechanism 80 provides the necessary adjustments to assure alignment of each lift post 82 with one another relative to refractory base 43. In addition, because each tubular housing 86 receives a bottom end 87 of lift post 82, there is established one guide on the scissors mechanism 80 which insures straight line motion of each list post 82.

Figure 3A:
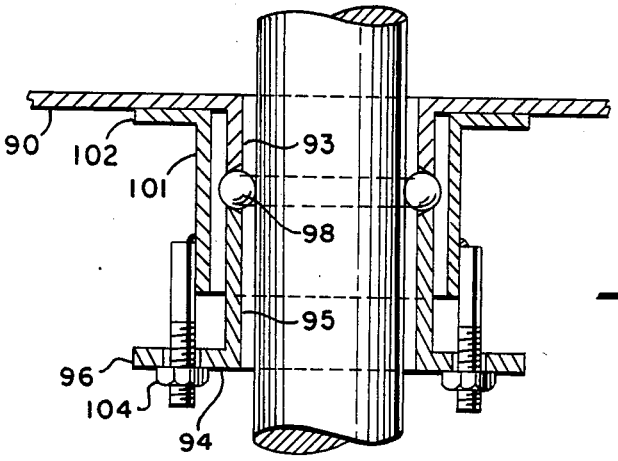
FIG. 3*a* is an enlarged detail of the stuffing box shown in FIG. 3.

A stuffing box arrangement 88 is used to provide a seal between furnace chamber 30 and lift posts 82 and is best shown in FIG. 3 and 3*a* to comprise a first guide plate 90 which is bolted in a sealed (Permatex) manner as shown at 91 to bottom furnace casing 64. First guide plate 90 includes an annular boss section 93 slightly greater in diameter than that of lift post 82. A second guide plate 94 has a tubular section 95 equal to that of boss section 93 and a flat annular base section 96 extending from tubular section 95. First and second guide plates 90, 94 are orientated so that tubular section 95 of second guide plate 94 faces boss section 93 of first guide plate 90 with a packing such as Fibrefax 98 compressed therebetween thus effecting a seal between first and second guide plates 90, 94 and lift post 82. A collar member 100 having a tubular section 101 fitting over boss section 93 of first guide plate 90 and a portion of tubular section 95 of second guide plate 94 has an annular flange section 102. Annular flange section 102, first guide plate 90 and base section 96 are secured together as shown by bolts 104 threaded into blind holes in first guide plate 90. Stuffing box arrangement 88 thus functions not only to seal furnace chamber 30 despite the motionof lifting post 82 into and out of furnace chamber 30, but the arrangement provides a guide which in combination with the guide established by tubular receiving housing 86 establishes two guide points to insure that the posts are moved in a vertically straight up and down motion thus insuring that refractory base 43 does not cock or tilt as retractable roller hearth 40 is raised or lowered.

Additionally, the fact that there are four separate lift posts 82, with each post aligned by two guides as noted, operated by a common scissor jack mechanism 80 and in combination with the aligning features of rail support post arrangement 54 results in a very accurately positioned retractable roller hearth. Specifically, the distance or spacing 112 between peripheral edge surface 46 of refractory base 43 and the similarly configured lower furnace refractory portion 105 of furnace chamber 30 surrounding peripheral edge surface 46 can be controlled to about ¼" (one-fourth inch) without binding which, considering the weight of refractory base 43 and the thermal expansion of the refractory, is significant in the furnace art.

The alignment features of retractable roller hearth 40 permit a highly efficient, but simple sealing mechanism to be employed to divide furnace chamber into an upper furnace enclosure 107 and a lower furnace enclosure 108 when retractable roller hearth 46 is in the raised position. The sealing mechanism includes a continuous annular hearth groove 110 formed in peripheral edge surface 46 which circumscribes refractory base member 43. Packed within groove 110 (which is preferably square shaped) is a fibrous, rope seal 111 which extends into the space 112 between peripheral edge surface 46 and lower furnace refractory portion 105. Seal 111 in practice is a 1½" square fibrous, ceramic rope such as that marketed as "Fibrefax". A similar annular refractory groove 114 is provided in lower furnace refractory portion 105 but spaced upwardly from annular hearth groove 110 a distance approximately equal to the hearth travel (i.e. about 3") and an identical chamber rope seal 115 is packed in refractory groove 114. The space or distance 112 is approximately 3/4" and each rope seal 111, 115 extends from opposite sides into space 112 about ½". When refractory base 43 is raised hearth rope seal 111 contacts refractory rope seal 115 to seal upper furnace enclosure 107 from lower furnace enclosure 108. Despite the fact that bottom furnace casing section 64 is sealed by a fibrous, blanket insulation (as shown by reference numeral 120), lower furnace enclosure 108 is at a lower temperature than upper furnace enclosure 107. When certain heat treat processes are carried out in furnace 10, notably carburizing, the lower temperature in lower furnace enclosure 108 will cause carbon to precipitate or be deposited thus reducing the efficiency of the process and resulting in unnecessary down time for furnace cleaning. By using the sealing arrangement disclosed, all the carbon potential of the furnace processing gases is deposited on the workpieces within work tray 22 resulting in a more efficient heat treat process from a gas consumption viewpoint as well as potentially faster processing times. As noted this is made possible by the built-in alignment features of the hearth which permits a simple rope seal to seal the entire peripheral edge surface of retractable, roller hearth 40 despite the lifting, the mass of the hearth and the work, and the thermal expansion or distortion which the hearth and furnace chamber 30 are exposed to.

Figure 4:
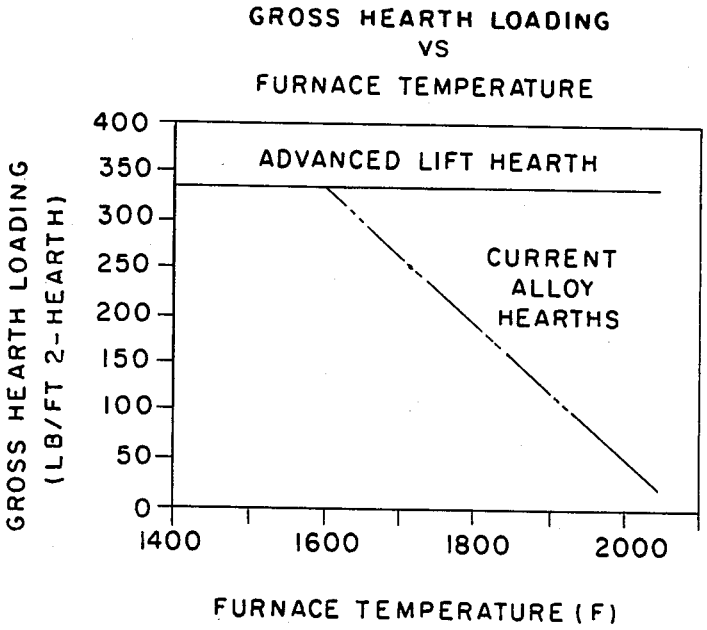
FIG. 4 is a graph illustrating the effects of furnace temperature on an alloy roller hearth.

The primary aspect of the invention can be appreciated by reference to FIG. 4. Multi-chambered industrial heat treat furnaces are principally designed as such so that the temperature of furnace chamber 30 is maintained at an elevated state during the charging and discharging stages although some temperature drop must occur. A normal heat treat cycle is generally about four hours in duration. If the conventional roller hearth must support the load during the entire cycle, the thermal stress over the four hour cycles shortens the life of the roller rails as shown by the dotted line. Thus to maintain the hearth life, the loading of the hearth (and thus the capacity of the furnace) was reduced. In accordance with the present invention the rollers are only loaded for about 1% of the heat treat cycle and only during the discharge or charging stages before the initial, high temperature heating stage of the cycle is actuated. During that high heating stage, i.e. in excess of 2,000° F., rollers 25 are not under load and the thermal stress induced by the high temperatures does not exceed the elastic limit. When the rollers are actuated, the furnace temperature may be at its lower value where higher work tray stresses can be tolerated and the loading time is short to obviate any adverse effects of fatigue or creep.

The invention has been described with reference to a preferred embodiment. Obviously, modifications and alterations will occur to those skilled in the art. For example, it is possible to keep the hearth stationary and move the rail posts by the scissors mechanism. While such a modification could obviate the seal mechanism of the hearth, it is not the preferred arrangement because the hearth would have to support the work tray below the track elevation line and there are occasions where the tray can be skewed within the furnace chamber or not pulled entirely within the chamber and in such instance "hang up". This cannot occur in the preferred embodiment. Yet another modification would be to provide deeper pockets within refractory base 43 for the rail support arrangement 54 to be withdrawn in and to provide such pockets with a cooling arrangement so that the rollers 60, etc. would not be even exposed to any of the initial high heat temperatures of furnace 10. This could be accomplished by extending support tiles 70 in a solid line and using a work tray 22 with a solid bottom. The support tiles 70 and H tile 75 and tray 22 would provide a passage for circulating a cooling fluid therein which would be thermocoupled controlled to prevent the temperature from rising beyond a fixed point, say 1850° F. However, this modification, while contemplated, does not form part of the preferred embodiment because, as demonstrated in FIG. 4, the thermal stress does not, within current initial, high heat schemes exceed the elastic limit of the alloy rollers. Furthermore, the contemplated modifications could adversely affect the processing time because furnace atmosphere cannot circulate beneath the work tray through the work, although conceivably other arrangement could be employed to overcome this disadvantage. It is my intention to include all such modifications and alterations insofar as they come within the scope of my invention.

Having thus described my invention, the following is claimed:

1. A retractable roller hearth arrangement for use in an industrial heat treat furnace having a furnace chamber surrounding said hearth into which metallic workpieces placed in a work tray are to be heat treated, said hearth comprising:

(a) a refractory base having a bottom surface, a top surface, and a closed peripheral edge surface extending between said bottom and top surfaces;

(b) tile support means extending from said top surface of said refractory base for supporting, when actuated, said work tray when said furnace chamber is heat treating said work;

(c) roller rail means positioned on said top surface of said refractory base and including a plurality of rollers for supporting, when actuated, said work tray and permitting movement of said tray into and out of said furnace chamber in a rolling, anti-friction bearing manner;

(d) hearth lift means for moving said roller rail means relative to said tile means while maintaining said refractory base within said furnace chamber for selectively actuating said roller rail means to support said work tray when said tile support means is not actuated and selectively actuating said tile support means when said roller rail means is not actuated whereby the load-sustaining capacity of said rollers is maintained.

2. The hearth arrangement of claim 1 further including sealing means between said refractory base and said furnace chamber for sealing said furnace chamber into a first and a second enclosure when said hearth lift means actuates said tile support means, said first enclosure including said work tray and said top surface of said refractory base, said second enclosure including said bottom surface of said refractory base.

3. The hearth arrangement of claim 2 wherein said roller rail means includes a first and second roller rail guide, each guide supporting a plurality of said rollers in a line extending from one end to the opposite end of said refractory base; a plurality of stationary post guide assemblies equally positioned along the length of each roller rail guide, one end of each post assembly secured to said roller rail guide and the opposite end of each post assembly secured to a fixed point in said furnace chamber, each post assembly extending through said refractory base from said top surface through said bottom, said hearth lift means effective to move said refractory base relative to each stationary post assembly, said stationary post assemblies maintaining said refractory base in substantial alignment within said furnace chamber.

4. The hearth arrangement of claim 3 wherein said tile support means includes at least a first and a second tile extending from said top surface of said refractory base a fixed distance such that when said tile support means is actuated by said hearth lift means, said tiles extend beyond said rollers for supporting said work tray and when said tile support means is unactuated, said rollers extend beyond said tiles for supporting said work.

5. The hearth arrangement of claim 4 wherein said tile support means further includes a plurality of tiles extending from said top surface of said refractory base, each tile in a substantially U-shaped configuration, said U-shaped tile generally parallel to said roller rail guide and extending end to end from one end of said refractory base to the opposite end thereof; and chain means disposed, in part, within the bight portion of said U-shaped tiles for transferring said work tray to and from said furnace chamber.

6. The hearth arrangement of claim 5 wherein said bottom surface of said refractory base has at least one structural member secured thereto extending generally from one side to the opposite side of said refractory base member generally perpendicular to the direction of said rail member; at least one lift post secured at one end to said structural member and extending in a sealed manner through said furnace enclousre, and lift means outside of said furnace chamber secured to the opposite end of said lift post for moving said lift post in an axial direction whereby said refractory base member is raised or lowered relative to said work tray.

7. The hearth arrangement of claim 6 wherein said sealing means further includes a first fibrous rope member disposed within a groove formed about said peripheral edge surface, said rope member extending outwardly beyond said edge surface, a similar second rope member similarly disposed within a groove formed within said furnace chamber and axially spaced from said rope member, said hearth lift mechanism when actuating said tile support means effective to cause said first rope member to contact said second rope member whereby said furnace chamber is divided into said first and second enclosures while permitting thermal expansion of said refractory base without binding against said furnace chamber.

8. The hearth arrangement of claim 7 wherein a plurality of first tile members are provided adjacent said roller guide member and extending at spaced intervals in a straight line from one end of said refractory base member to the other end thereof whereby said intervals provide paths for circulating furnace atmosphere through said workpiece from the bottom of said work tray.

9. The hearth arrangement of claim 8 wherein the bottom of said furnace chamber is defined by a bottom furnace plate spaced from but overlying said bottom surface of said refractory base, at least one opening in said bottom plate through which said lift post extends, a first guide plate having boss portion with an opening therethrough through which said lift post extends sealingly secured to the outside of said bottom plate, an open-ended cylindrical stuffing box member having a flanged end secured to said first guide plate and circumscribing and extending past said boss portion, a second, open-ended cylindrical guide plate having a flanged end through which said lift post extends, one end of said second guide plate extending within said stuffing box member and adjacent one end of said first guide plate, a fibrous seal disposed therebetween and means for fastening said flanged end of said second guide member to said flanged end of said stuffing box member for sealing said second furnace enclosure and insuring axial movement of said lift member within said furnace chamber.

10. The hearth arrangement of claim 9 wherein said lift means included a tubular member receiving said opposite end of said lift post, said stuffing box and said tubular member insuring straight line motion of said lift posts.

11. The hearth arrangement of claim 10 wherein six rail support posts and four lift posts are employed to insure straight line motion of said refractory base.

12. The hearth arrangement of claim 1 wherein said roller rail means includes a first and second roller rail guide, each guide supporting a plurality of said rollers in a line extending from one end to the opposite end of said refractory base; a plurality of stationary post guide assemblies equally positioned along the length of each roller rail guide, one end of each post assembly secured to said roller rail guide and the opposite end of each post assembly secured to a fixed point in said furnace chamber, each post assembly extending through said refractory base from said top surface through said bottom, said hearth lift means effective to move said refractory base relative to each stationary post assembly, said stationary post assemblies maintaining said refractory base in substantial alignment within said furnace chamber.

13. The hearth arrangement of claim 12 wherein said bottom surface of said refractory base has at least one structural member secured thereto extending generally from one side to the opposite side of said refractory base member generally perpendicular to the direction of said rail member; at least one lift post secured at one end to said structural member and extending in a sealed manner through said furnace enclosure, and lift means outside of said furnace chamber secured to the opposite end of said lift post for moving said lift post in an axial direction whereby said refractory base member is raised or lowered relative to said work tray.

14. The hearth arrangement of claim 13 wherein the bottom of said furnace chamber is defined by a bottom furnace plate spaced from but overlying said bottom surface of said refractory base, at least one opening in said bottom plate through which said lift post extends, a first guide plate having boss portion with an opening therethrough through which said lift post extends sealingly secured to the outside of said bottom plate, an open-ended cylindrical stuffing box member having a flanged end secured to said first guide plate and circumscribing and extending past said boss portion, a second, open-ended cylindrical guide plate having a flanged end through which said lift post extends, one end of said second guide plate extending within said stuffing box member and adjacent one end of said first guide plate, a fibrous seal disposed therebetween and means for fastening said flanged end of said second guide member to said flanged end of said stuffing box member for sealing said second furnace enclosure and insuring axial movement of said lift member within said furnace chamber.

15. The hearth arrangement of claim 14 wherein said lift means included a tubular member receiving said opposite end of said lift post, said stuffing box and said tubular member insuring straight line motion of said lift posts.

16. The hearth arrangement of claim 15 wherein eight rail support posts and four lift posts are employed to insure straight line motion of said refractory base.

17. The hearth arrangement of claim 3 wherein said tile support means includes at least a first and a second tile extending from said top surface of said refractory base a fixed distance such that when said tile support means is actuated by said hearth lift means, said tiles extend beyond said rollers for supporting said work tray and when said tile support means is unactuated, said rollers extend beyond said tiles for supporting said work.

18. The hearth arrangement of claim 17 wherein said tile support means further includes a plurality of tiles extending from said top surface of said refractory base, each tile in a substantially U-shaped configuration, said U-shaped tile generally parallel to said roller rail guide and extending end to end from one end of said refractory base to the opposite end thereof; and chain means disposed, in part, within the bight portion of said U-shaped tiles for transferring said work tray to and from said furnace chamber.

19. The hearth arrangement of claim 18 wherein a pluraliy of first tile members are provided adjacent said roller guide member and extending at spaced intervals in a straight line from one end of said refractory base member to the other end thereof whereby said intervals provide paths for circulating furnace atmosphere through said workpiece from the bottom of said work tray.

20. The hearth arrangement of claim 2 wherein said sealing means further includes a first fibrous rope member disposed within a groove formed about said peripheral edge surface, said rope member extending outwardly beyond said edge surface, a similar second rope member similarly disposed within a groove formed within said furnace chamber and axially spaced from said rope member, said hearth lift mechanism when actuating said tile support means effective to cause said first rope member to contact said second rope member whereby said furnace chamber is divided into said first and second enclosures while permitting thermal expansion of said refractory base without binding against said furnace chamber.

21. A batch type, industrial heat treat furnace for heat treating ferrous workpieces placed in a work tray comprising;

a sealed furnace chamber;

means for heating said furnace chamber;

fan means for circulating a heat treating atmosphere gas within said furnace;

a refractory base having a bottom surface, a top surface, and a closed peripheral edge surface extending between said bottom and top surfaces;

tile support means extending from said top surface of said refractory base for supporting, when actuated, said work tray when said furnace chamber is heat treating said work;

roller rail means positioned on said top surface of said refractory base and including a plurality of rollers for supporting, when actuated, said work tray and permitting movement of said tray into and out of said furnace chamber in a rolling, anti-friction bearing manner;

hearth lift means for moving said roller rail means relative to said tile means while maintaining said refractory base within said furnace chamber for selectively actuating said roller rail means to support said work tray when said tile support means is not actuated and selectively actuating said tile support means when said roller rail means is not actuated whereby the life of said hearth arrangement is increased.

22. The furnace of claim 21 wherein said means for heating said furnace are effective to heat said heat treating atmosphere to temperatures in excess of 2100° F. until said workpieces reach a temperature whereat a heat treating process occurs.

23. The hearth arrangement of claim 22 further including sealing means between said refractory base and said furnace chamber for sealing said furnace chamber into a first and a second enclosure when said hearth lift means actuates said tile supports means, said first enclosure including said work tray and said top surface of said refractory base, said second enclosure including said bottom surface of said refractory base.

24. The hearth arrangement of claim 22 wherein said tile support means includes at least a first and a second tile extending from said top surface of said refractory base a fixed distance such that when said tile support means is actuated by said hearth lift means, said tiles extend beyond said rollers for supporting said work tray and when said tile support means is unactuated, said rollers extend beyond said tiles for supporting said work.

25. The hearth arrangement of claim 22 wherein said bottom surface of said refractory base has at least one structural member secured thereto extending generally from one side to the opposite side of said refractory base member generally perpendicular to the direction of said rail member; at least one lift post secured at one end to said structural member and extending in a sealed manner through said furnace enclosure, and lift means outside of said furnace chamber secured to the opposite end of said lift post for moving said lift post in an axial direction whereby said refractory base member is raised or lowered relative to said work tray.

26. The hearth arrangement of claim 25 wherein the bottom of said furnace chamber is defined by a bottom furnace plate spaced from but overlying said bottom surface of said refractory base, at least one opening in said bottom plate through which said lift post extends, a first guide plate having boss portion with an opening therethrough through which said lift post extends sealingly secured to the outside of said bottom plate, an open-ended cylindrical stuffing box member having a flanged end secured to said first guide plate and circumscribing and extending past said boss portion, a second, open-ended cylindrical guide plate having a flanged end through which said lift post extends, one end of said second guide plate extending within said stuffing box member and adjacent one end of said first guide plate, a fibrous seal disposed therebetween and means for fastening said flanged end of said second guide member to said flanged end of said stuffing box member for sealing said second furnace enclosure and insuring axial movement of said lift member within said furnace chamber.

27. A rectangular, retractable roller hearth for use in a rectangular furnace chamber surrounding said hearth, said hearth comprising;

(a) a refractory base member having a top surface, a bottom surface and a peripherally extending edge surface therebetween;

(b) said refractory base having a first plurality of openings, spaced along a first longitudinally-extending centerline extending therethrough, said refractory base having a second plurality of openings spaced along a second longitudinally-extending centerline extending therethrough, said second centerline spaced laterally from said first centerline;

(c) a first longitudinally-extending rail centered on said first centerline and extending from one end to the opposite end of said refractory base member, a second longitudinally-extending rail centered on said second centerline and extending from one end to the opposite end of said refractory base member, each rail supporting a plurality of alloy rollers spaced therealong;

(d) a plurality of longitudinally-extending ceramic tiles extending from said top surface a fixed distance relative to the position of said rollers;

(e) a rail support post extending through each of said first and second plurality of openings; each rail support post having one end connected to one of said first and second guide members and an opposite end connected to said furnace chamber at a point spaced from said bottom surface of said refractory base; each plurality of openings having a tubular collar member inserted therein from said bottom surface closely surrounding said rail support post;

(f) a structural member secured to said bottom surface at the intersection of said bottom surface with said edge surface to define a peripherally extending framework supporting said refractory base;

(g) a first and second structural beam member laterally extending from one side to the other side of said refractory base member and secured to said structural member;

(h) a first, second, third and fourth lift post, each post extending through said furnace chamber and having an end outside said furnace chamber secured to lift means for moving said lift post relative said furnace chamber and an end inside said furnace chamber secured to one of said beam members, said inside end of said first list post positioned at a point underlying said first centerline, said inside end of said second lift post underlying said second centerline, said inside end of said third lift post underlying said first centerline at a point removed from said first lift post and said inside end of said fourth post underlying said second centerline at a point removed from said second post whereby said hearth is moved in a straight line motion by said lift means to move said tiles above or below said alloy rails.

28. The hearth of claim 27 further including sealing means between said refractory base and said furnace chamber for sealing said furnace chamber into a first and a second enclosure when said hearth lift means actuates said tile support means, said first enclosure including said top surface of said refractory base, said second enclosure including said bottom surface of said refractory base.

29. The hearth of claim 28 wherein said sealing means further includes a first fibrous rope member disposed within a groove formed about said peripheral edge surface, said rope member extending outwardly beyond said edge surface, a similar second rope member similarly disposed within a groove formed within said furnace chamber and axially spaced from said rope member, said hearth lift mechanism when actuating said tile support means effective to cause said first rope member to contact said second rope member whereby said furnace chamber is divided into said first and second enclosures while permitting thermal expansion of said refractory base without binding against said furnace chamber.

* * * * *